United States Patent [19]

Lamothe

[11] 4,098,361

[45] Jul. 4, 1978

[54] DRILLING HEAD CONNECTION FOR USE IN A REVERSE CIRCULATION SYSTEM

[75] Inventor: Andre Lamothe, Paris, France

[73] Assignee: Foraco Forage Rational Construction, Paris, France

[21] Appl. No.: 724,834

[22] Filed: Sep. 20, 1976

[30] Foreign Application Priority Data

Sep. 19, 1975 [FR] France ..... 75 28797

[51] Int. Cl.[2] ..... E21B 9/20

[52] U.S. Cl. ..... 175/325; 175/60; 175/403; 175/215

[58] Field of Search ..... 175/60, 65, 215, 403, 175/67-69, 325, 324, 339

[56] References Cited

U.S. PATENT DOCUMENTS

| | | | |
|---|---|---|---|
| 3,419,092 | 12/1968 | Elenburg | 175/69 |
| 3,667,555 | 6/1972 | Elenburg | 175/215 |
| 3,712,392 | 1/1973 | Gorgendiere | 175/215 |
| 3,747,698 | 7/1973 | Chapman | 175/215 |
| 3,941,196 | 3/1976 | Curington et al. | 175/215 |

FOREIGN PATENT DOCUMENTS

| | | | |
|---|---|---|---|
| 1,086,534 | 10/1967 | United Kingdom | 175/215 |

*Primary Examiner*—James A. Leppink
*Attorney, Agent, or Firm*—Sughrue, Rothwell, Mion, Zinn & Macpeak

[57] ABSTRACT

The invention relates to a drilling head connection specifically designed for reverse circulation operation and the connection can be screwed on a double pipe system in such a way that the drilling fluid injected into the annular space passes through the annular channel and thereafter through the channel of the drilling head so as to lubricate the leading surfaces of the bit and the plug moves up through the inner space with the excavation material passing through the lateral channels and also the connection can be used with any drilling head.

3 Claims, 2 Drawing Figures

DRILLING HEAD CONNECTION FOR USE IN A REVERSE CIRCULATION SYSTEM

BACKGROUND OF THE INVENTION

1 Field of the Invention

The present invention relates to a connection for a drilling head and, more particularly, to a connection for drilling heads employed in reverse circulation drilling in which the drilling fluid penetrating the annular zone returns the excavation material through the piping. The invention also relates to the method of employing this connection when an annular zone is produced by means of double piping.

2. Description of the Prior Art

There are numerous types of drilling heads: certain being used to obtain plugs of predetermined size, but whatever the type of tool employed, there is always the difficulty of the complete removal of the excavated material resulting from the advancement of the drilling head. Defective disengagement of the excavation material directly beneath the drilling head considerably slows down the advancement of the drilling tool irrespective of the drilling method employed: simple rotation of the tool or a complex rotating, vibrating and stamping movement and irrespective of the drilling fluid employed: pressurized sludge or air.

SUMMARY OF THE INVENTION the present invention relates to a tubular connection for a drilling head characterized in that at one of its ends it comprises an annular space surrounding a central tubular passage; the annular space communicating with at least one longitudinal channel traversing the thickness of the connection and discharging at one end of the connection. A lateral channel brings the central passage into communication with the outside.

Accordingly, it is merely necessary to provide a conventional attachment means for the drilling head to be used, in the central passage not enclosed by the annular part, and to provide another conventional attachment means for the double pipe employed, at the end of the connection comprising the annular part, in order to supply the head with drilling fluid by means of the longitudinal channel and to remove through the lateral channel all the excavation material resulting from the drilling effected by the rotational movement or stamping movement of the drilling head. As a result, an extremely manageable and efficient connection is obtained by virtue of the fact that it enables a different type of drilling head to be attached by conventional means, on the one hand, and it makes it possible, on the other hand, to completely free all the excavation material by means of the drilling fluid flowing from the annular space into the wall of the connection so as to cross and lubricate the drilling head; the excavation material rejoining the plug through the lateral channel traversing the wall and rising with the same in the central passage. As a result, a plug accompanied by excavation material enclosing the plug at the level in point, is brought up to the surface.

Another object of the invention is to increase the proportion of excavation material which is drawn along to the amount of excavation material which is torn loose by making the lateral channel crossing the thickness of the wall of the connection overlap two zones of different thickness, the zone having the smallest radius being disposed adjacent to the drilling head, such that a preferred path is produced for the excavation material flowing in the central passage, thus preventing any drilling blockages.

The invention also relates to a method of employing the above-described connection consisting in adapting to the connection any drilling head whose largest radius is substantially equal to the largest radius of the connection and whose smallest radius is preferably similar to the smallest radius of the connection.

In this manner it is possible to further increase the advancement rate of the drilling head; the circulation of the fluid and the excavation material being facilitated by the wide passage obtained by reducing the radii of the tool and the connection in certain zones and also by the blocking action and guidance offered to the excavation material by the increase in the section of the connection above the opening of the lateral channel; the plug formed by the conventional central opening of the drilling head also being raised more easily by the pressure exerted by the drilling fluid.

Other objects, features and advantages of the present invention will be made apparent in the course of the following description of an embodiment of the connection provided by way of a non-limitative example with reference to the accompanying drawings.

DESCRIPTION OF THE PREFERRED EMBODIMENT

Figure 1:
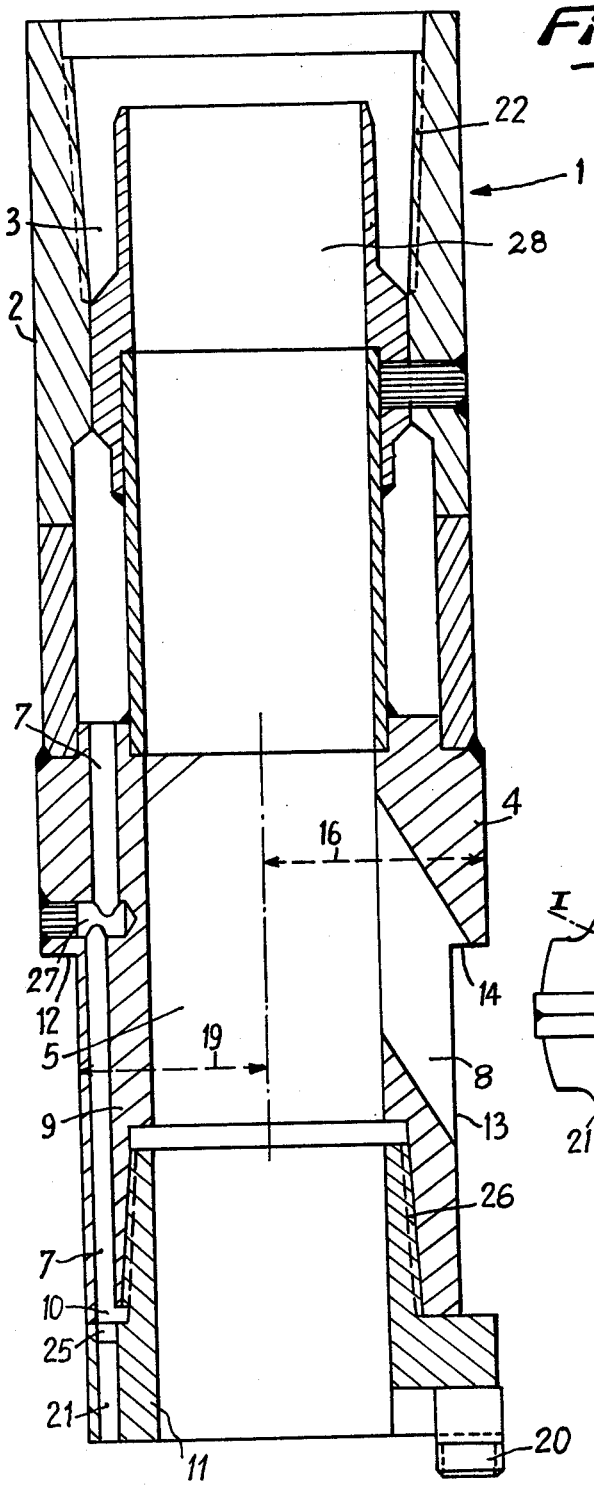
FIG. 1 shows a section through the connection along the line I—I of FIG. 2.

The embodiment which is represented by way of example corresponds to the use of the annular space in a double pipe as the delivery channel for the drilling fluid consisting of pressurized air or sludge.

The connection 1 consists of a part 2 comprising an annular zone 3 surrounding the central passage 5 and a part 4 extending the central passage 5. This part 4 also comprises at least one longitudinal channel 7 communicating with the annular zone 3 and crossing internally through the part 9 of the wall of the connection to discharge at 10 in the head 11. The part 4 of the connection also comprises a lateral channel 8 bringing the central passage 5 into communication with the outside. It will be noted that the channel 8 overlaps a shoulder 12 of the connection such that the opening, at which the channel discharges, is formed of the vertical part 13 and the horizontal part 14. As a result, the excavation materials are stopped by the shoulder 12 and penetrate the orifice 13, 14.

Figure 2:
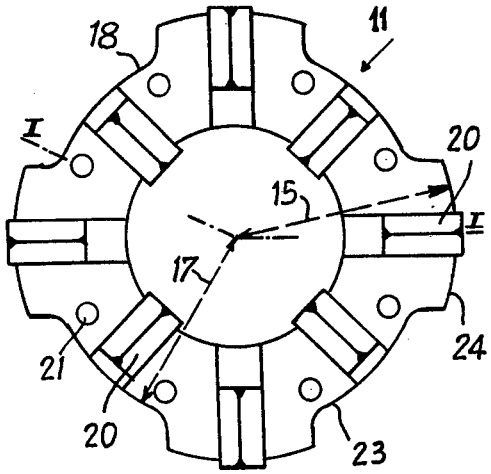
FIG. 2 is a view from below of the drilling head.

The removal of the excavation materials is further facilitated according to the invention by the provision of a drilling head such as the one shown in FIG. 2, the radius 15 of which is substantially equal to the radius 16 of the outer wall of the zone 4 of the connection. Similarly, the radius 17 of the head bordering the zone 18 is substantially equal to the zone 19 of the part 9 of the connection. The leading zones 20 of the tool can be of any particular type and can comprise diamonds which may or may not be embedded in a metallic mass containing a high quantity of tungsten or other conventional composition. The channels 21 convey the drilling fluid coming from the channels 7 to the leading zones 20.

Accordingly, the drilling fluid consisting, for example, of compressed air, coming from the annular region of the double pipes, which are connected by means of threading 22 to the connection 1, flows through the channels 7 and thereafter 21 to the leading surfaces 20 of the head 11. The fluid is released and facilitates the insertion of the plug in the central space 5. It simultaneously brings all the excavated material into this same space located between the drilling wall and the zones 23, having the smallest radius, located between two consecutive zones 24 having a larger radius and thereafter through the lateral channel 8. Owing to the drilling diameter which is obtained by appropriately selecting the dimensions of the head and the connection, it will be noted that all the excavation material which escapes at the part 13 of the orifice of the lateral channel is absorbed by the part 14 and it is also prevented from entering the annular space between the drill and the connection 1 by the presence of the shoulder 12.

To ensure a good flow rate through the channels 7 and 21, which need not be aligned, grooves 25 are provided which can either be situated at the lower part of the connection comprising the threading 26 or above the head 11. The connection is so dimensioned that after it has been screwed in place the channels will be connected in an efficient manner.

The number and disposition of the leading zones could obviously be varied, while the above-described conditions remain unchanged. Similarly, although the lateral channels 8 are regularly spaced about the connection axis, the longitudinal channels 7 can consist of a plurality of parts which are staggered with respect to one another and which are interconnected by means of the transversal channels 27.

Lastly, the connection 1 can be used with a single set of pipes which only extend the inner tubular part 28 of the connection; the annular space located between the set of pipes and the wall of the base communicating with the channels 7.

What is claimed is:

1. A drilling head connection having connecting means at one end for the attachment of an annular drilling tool having a central passage therethrough and connecting means at the opposite end for connection to a drilling pipe, said drilling head connection having a central passage extending therethrough adapted to communicate with the central passage of said drilling tool and an annular passage surrounding said central passage for directing a drilling fluid toward said drilling tool, external annular shoulder means located on said drilling head connection spaced from said one end thereof and lateral passage means extending between said central passage of said drilling head connection and the exterior surface thereof at said annular shoulder means whereby a plug cut by an annular drilling tool can pass upwardly through the central passage of the drilling tool and the central passage of said drilling head connection while excavated material passing about the outer circumference of the annular drilling tool will be directed by said annular shoulder means through said lateral passage means to said central passage of said drilling head connection for conveyance to the surface by means of said drilling fluid.

2. A drilling head connection as set forth in claim 1 wherein said annular passage is formed in said drilling head connection between said lateral passages and said other end of said drilling head connection and further comprising longitudinally extending passage means adapted to connect said annular passage with drilling fluid passages in a drilling tool connected at said one end of said drilling head connection.

3. A drilling head connection as set forth in claim 1 wherein said annular shoulder means is defined by an intermediate portion of said drilling head connection having an external diameter larger than the external diameter of said one end of said drilling head connection with said lateral passage means being disposed in communication with said one end of said drilling head connection and said shoulder means.

* * * * *